US005876033A

United States Patent [19]

Lonati

[11] Patent Number: 5,876,033

[45] Date of Patent: Mar. 2, 1999

[54] DEVICE TO STACK AND COLLECT BANKNOTES WITH THE POSSIBILITY OF RETURNING THEM

[75] Inventor: Pietro Antonio Lonati, Brescia, Italy

[73] Assignee: Officina Meccanica L.A.R. di Lonati Lorenzo & C. S.n.c., Brescia, Italy

[21] Appl. No.: 901,000

[22] Filed: Jul. 25, 1997

[51] Int. Cl.[6] ..... B65H 39/10

[52] U.S. Cl. ..... 271/298; 271/180; 271/213; 271/302; 414/792.7; 414/907

[58] Field of Search ..... 271/180, 181, 271/213, 218, 219, 298, 302; 414/789.9, 790.3, 792.7, 907

[56] References Cited

U.S. PATENT DOCUMENTS

| | | | |
|---|---|---|---|
| 4,050,562 | 9/1977 | Schwippert et al. | 271/180 |
| 4,809,966 | 3/1989 | Kobayashi et al. | 271/181 |
| 5,286,017 | 2/1994 | Hawk et al. | 271/180 |
| 5,322,275 | 6/1994 | Gardellini et al. | 271/219 |
| 5,419,423 | 5/1995 | Ishida et al. | 271/180 |
| 5,538,140 | 7/1996 | Guenther et al. | 271/298 |

*Primary Examiner*—David A. Bucci
*Assistant Examiner*—Douglas Hess
*Attorney, Agent, or Firm*—McGlew and Tuttle

[57] ABSTRACT

A device to stack and collect banknotes with the possibility of returning them. It comprises conveyors (18) to take every banknote at the level of the inlet (12) and to drag the buntnote and spread it on a support surface (14) over a central opening (14'), and a presser (19), set by the central opening of the support surface (14), that can be moved from a raised position over the support surface to a first work level causing the passage of every banknote under the support surface between, the presser and holders (17); and to a second work level to cause the banknotes to be discharged below the holders. The device moreover comprises a mechanism to return the banknotes after horizontal movements of the support surface (14).

6 Claims, 3 Drawing Sheets

DEVICE TO STACK AND COLLECT BANKNOTES WITH THE POSSIBILITY OF RETURNING THEM

FIELD OF THE INVENTION

The present invention pertains to the field of equipment to automatically distribute goods or services upon payment with banknotes, made through a banknote identifier, and more specifically refers to devices of stacking banknotes and collection in such equipment.

Suitable devices are already known for collecting banknotes after an identifier has identified them and for progressively accumulating the banknotes. The known devices are anyhow relatively complex, they have a winding path for the banknotes and are mostly not able to return banknotes if the user changes his mind and/or wants to stop the transaction in course in the dispenser.

It is an object of the present invention to propose a new, original device to collect and stack banknotes, of more simple manufacture, reliable to use and especially suitable for stacking and temporarily holding the banknotes it receives and returning them all if and when the operation in course has to be stopped due to the user changing his mind or giving up and/or due to a lack of the desired goods or service.

Such a purpose is achieved with a banknote collecting and stacking device according to claim 1 and which should be placed between a banknote reader-identifier and a container to receive the collected banknotes.

The invention shall anyhow be described in greater detail by the continuation of the description made with reference to the accompanying drawings, in which:

DESCRIPTION OF THE PREFERRED EMBODIMENT

Figure 1:
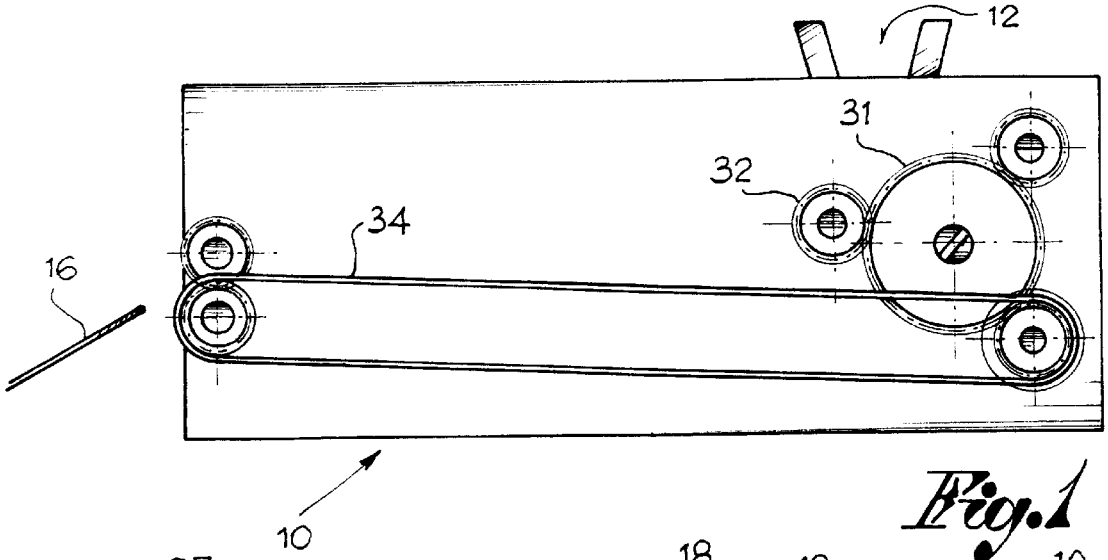
FIG. 1 is a side view of the device according to the invention.

In the preferred embodiment, the device at issue comprises a support body 10 with at least two sides 11 linked together and carrying an inlet 12 reached by the banknotes 13 to be collected that come from a banknote reader-identifier—not shown. Crossways, between said sides 11 there is a support surface 14 for the banknotes, supported and sliding horizontally on runners, for example under the form of rollers 15 applied onto the sides. Said support surface 14 extends under the inlet 12 to one end of the body 10 where there is an outlet channel or chute 16 for the banknotes to be returned if necessary. The support surface 14 has a central longitudinal opening 14'.

Under the support surface 14 there are two oscillating fins 17 to retain and accumulate the banknotes; above the support surface 14 there is a conveyor 18 and a presser 19 for the banknotes.

The oscillating fins 17 are set on opposite sides of the central opening 14' of the surface 14, turned towards each other and both hinged under the surface. Each oscillating fin 17 is stressed by at least one spring 20 acting in the direction of keeping the fin normally turned in a horizontal position, right next to the bottom face of the surface 14. In this position the fins 17 are coplanar and basically close the central opening 14' of the surface 14. They can anyhow be moved, by turning and to a different extent, far from the support surface, in opposition to the relative springs 20 as will clearly appear hereunder, in positions of partial and total opening.

The conveyor 18 extends above the support surface 14, parallel to it, starting from the inlet 12 of the banknotes where there are two check rollers 23 till close to the outlet channel or chute 16. Said conveyor 18 is the worm type, composed of two drive belts 21, each one driven on pulleys 22 supported inside the sides of the body 10. The belts 21 are set on opposite sides of the central opening 14' of the support surface 14, and each one has a branch passing adjacent to this support surface. The function of the conveyor 18 is to take every banknote to be collected to the level of the inlet 12 and to drag it to fully spread it out on the support surface 14 over the central opening of this surface.

The presser 19 is set and can be moved vertically at and through the central opening 14' of the support surface 14, said presser 19 having dimensions in length and width just a little under those of said central opening.

The vertical movements of the presser 19 can be obtained in various ways. In the embodiment described herein, the presser is carried by a system of pantograph levers 24 operated by an electric motor 25, through a transmission 26. Clearly, any other system, whether for support or control, can be adopted without leaving the sphere of the invention. In any case, with appropriate management of the means of control (25), the presser can be moved, starting from a rest position raised above the support surface, at a first work level A just under the support surface and at a second work level B more deeply under the support surface. With these movements to levels A and B, the presser acts to a different degree on the oscillating fins 17 determining a rotation for a partial or total opening respectively. Said movements of the presser are also finalized, respectively, to transferring each banknote from the support surface 14 to the oscillating fins 17, between these and the surface itself to accumulate and finally discharge the banknotes towards a collection container beneath.

When the presser 19 is raised in the rest position, the support surface 14 can be moved horizontally on the runners 15 between a withdrawn position, under the inlet 12 of the banknotes, and an advanced position towards the outlet channel or chute 16. When it is in the withdrawn position, the surface 14 can be locked by a stop bolt 27, controlled by an electromagnet 28, for instance.

In addition, adjacent to the outlet channel or chute 16, between this and the support surface 14, a pair of overlying return rollers 29 is fitted. They are interacting to take the banknotes at the level of the end of said surface 14 and to transfer them to the channel or chute when they have to be returned and when the surface 14 is moved alternately forwards and backwards after unlocking the bolt 27.

The above described device preferably includes just one motor unit to control the conveyor 18, the reciprocating movements of the support surface 14 and of the return rollers 29, even if these elements could be controlled by independent motors. The motor unit comprises an electric motor 30 whose output shaft controls a gear 31 that transmits the motion to the conveyor 18 through a cogged wheel 32, to the support surface 14 through a connecting rod 33, and to the return rollers 29 through a belt drive 34, for instance. Conveniently arranged sensors and/or limit switches govern starting and stopping the motor 30 just like that of the motor controlling the presser in relation to the succession of the operative phases of the appliance.

The operation of the device is as follows.

Figure 4:
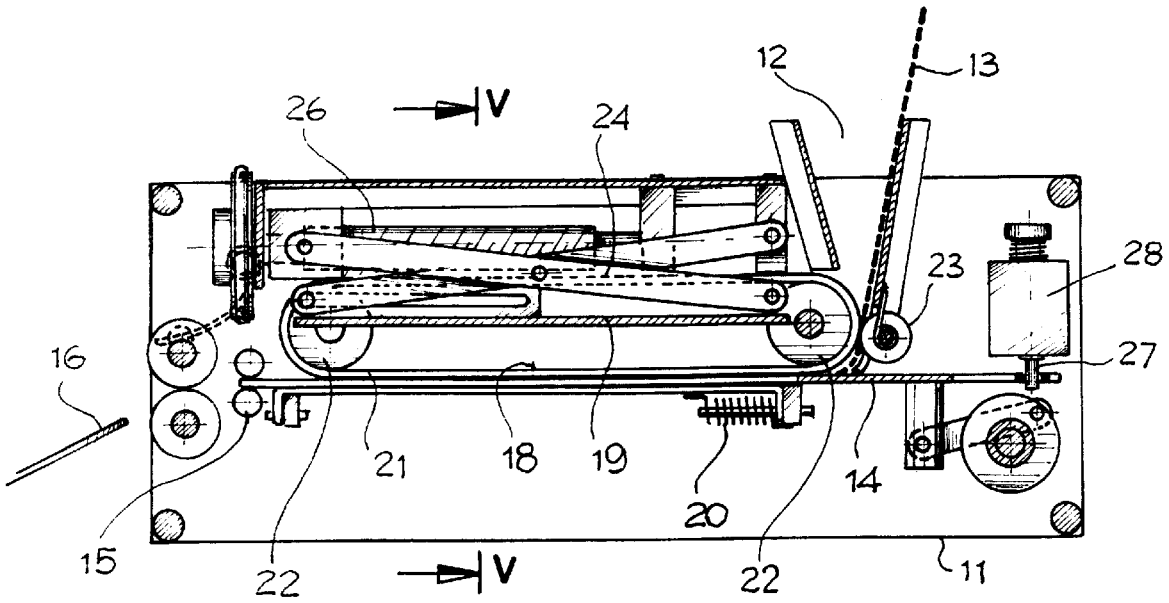
FIG. 4 is a longitudinal sectional view of the device while receiving a banknote.
Figure 5:
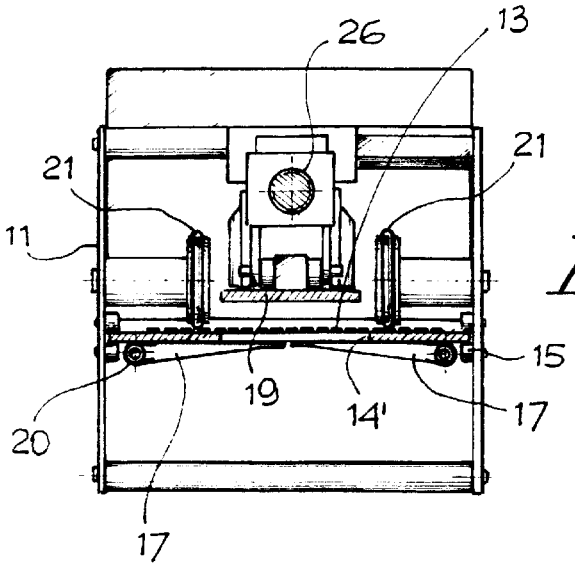
FIG. 5 is a cross-sectional view according to line V—V in FIG. 4 and with the device in the state of receiving a banknote.
Figure 6:
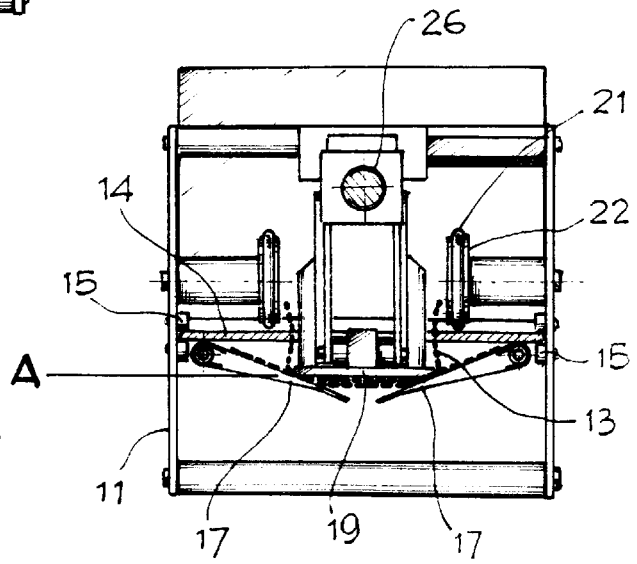
FIG. 6 is a sectional view similar to that in FIG. 5, but with the device in the state of accumulating and stacking the banknotes.

Normally, the support surface 14 is in its withdrawn position and locked by the bolt 27 and the presser 19 is raised into the rest position. The arrival of an accepted banknote 13 coming from the reader-identifier upstream causes the device to start up. The conveyor 18 is started up while the support surface and the presser remain stationary in their above mentioned positions. The conveyor 18 then takes one end of the banknote from the inlet and drags it onto the tilted surface to fully stretch it out on the support as shown in FIGS. 4 and 5. At this stage, while the conveyor is stopping, the presser 19 is controlled to lower through the central opening of the support surface down to the first work level A. The presser 19 lowering causes the banknote to lower and produces a push on the oscillating fins 17 that partially open as shown in FIG. 6. The movements of the presser and of the fins are such as to allow the banknote to pass under the surface through the central opening 14' and to settle with its longitudinal edges between the oscillating fins 17 and the surface. The presser then goes back upwards and the fins 17, stressed by the appropriate springs, close against the surface thereby locking the banknote. This happens for every additional banknote introduced thereafter. In practice, the banknotes are held and accumulated progressively between the fins 17 and the support surface 14.

At this stage the user has two options, by acting on two different controls or push-buttons: to enable collection of the banknotes introduced to collect the desired goods or service or to request the banknotes to be returned if he has changed his mind and wants to stop the transaction set in motion.

Figure 2:
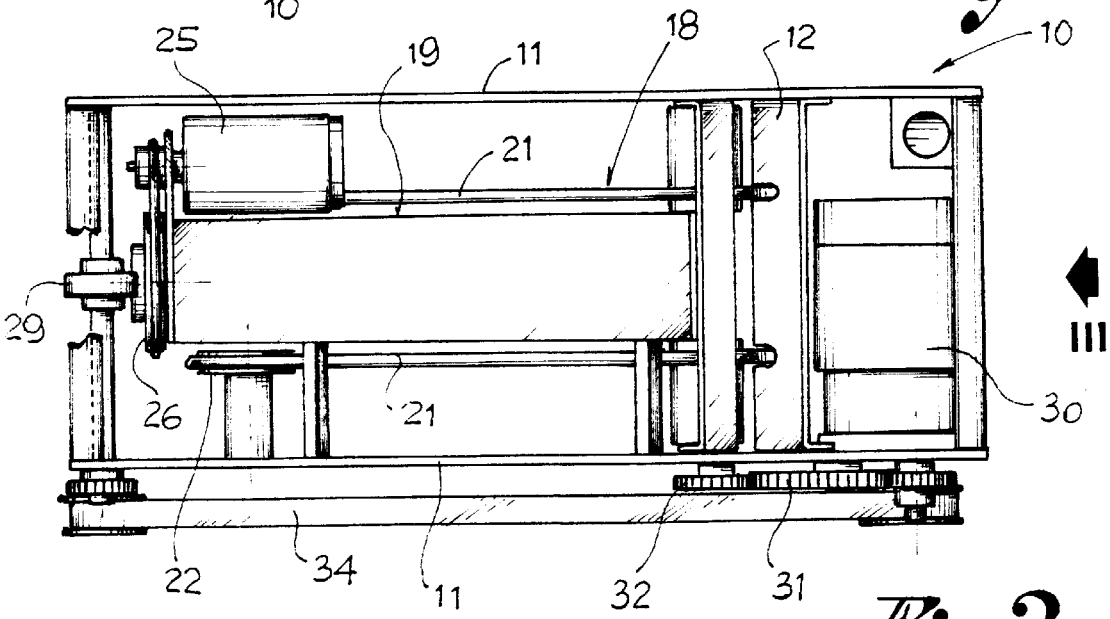
FIG. 2 is a plan view from above.
Figure 3:
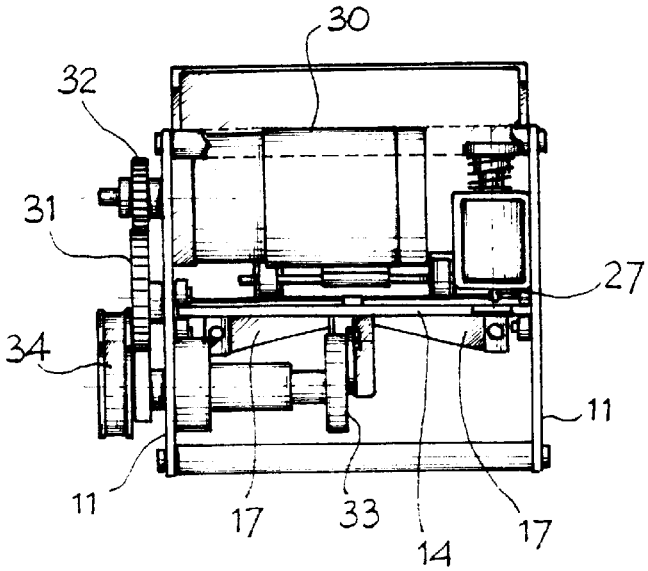
FIG. 3 is an end view according to the arrow III of FIG. 2.
Figure 8:
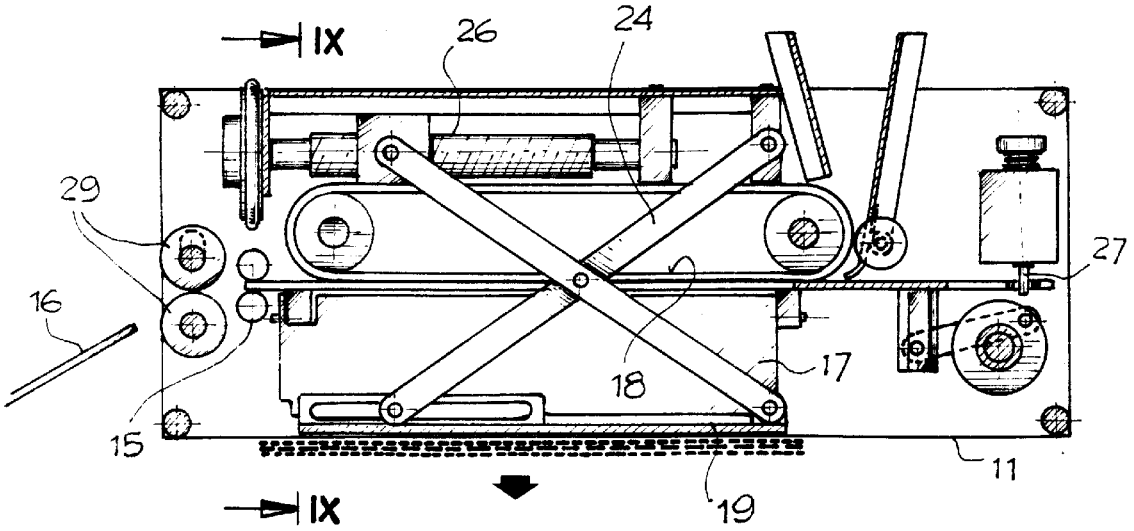
FIG. 8 is a longitudinal sectional view of the device in the phase of unloading the banknotes towards a box.
Figure 9:
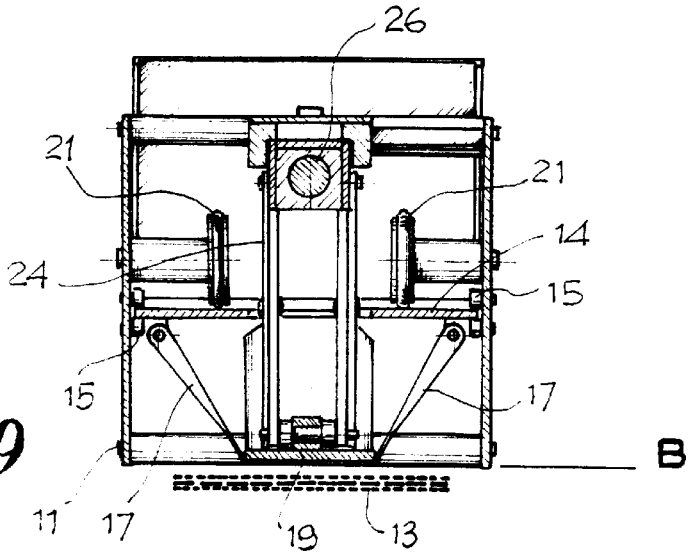
FIG. 9 is a cross-view of the device in accordance with the line IX—IX in FIG. 8.

In the first case, the user acts on a specific control or push-button that starts up the presser which, this time, lowers down to the lowest position B where it causes the oscillating fins to open fully for the banknotes to be discharged from the bottom of the device towards the cash container as shown in FIGS. 8 and 2.

Figure 7:
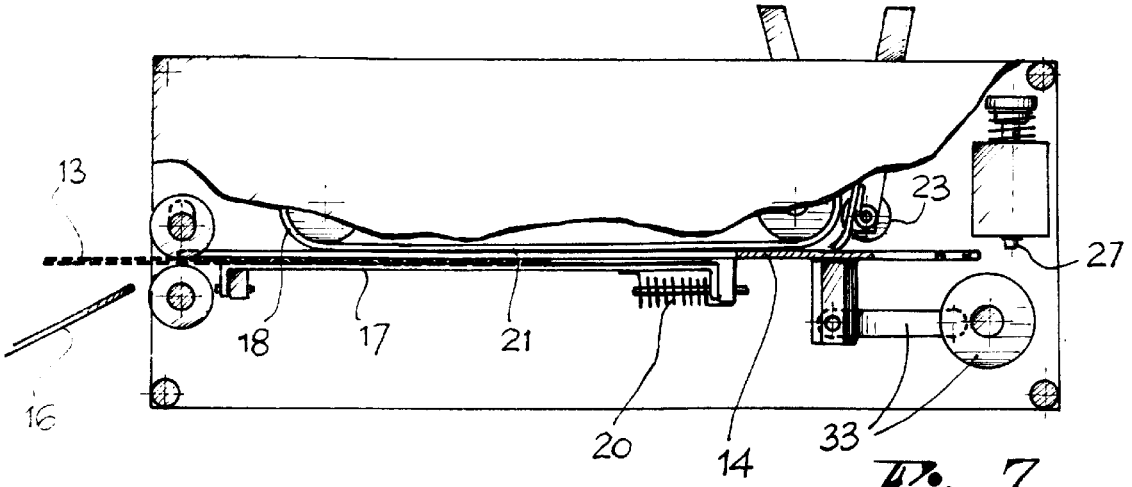
FIG. 7 is a longitudinal sectional view of the device in a phase of returning banknotes.

In the second case, the user acts on another control to cause the retainer bolt to release the support surface, keep the presser stationary, and start up the motor unit 31. Then, the support surface 14, controlled by the connecting rod 33, reciprocally moves forwards and backwards, the conveyor moves normally above the support surface and the return rollers turn. The reciprocating movements of the surface 14 combined with the action of the conveyor cause the banknotes to advance towards the return rollers. These rollers grip the banknotes, moving them to discharge them onto the outlet channel or chute as shown in FIG. 7 so that the user can recover them. The device is then reset in the starting position ready to accept other banknotes for another operating cycle of the dispenser appliance.

I claim:

1. A banknote collecting and stacking device with a banknote return feature, the device comprising a body with at least two sides connected together and carrying an inlet for the banknotes entering the device from a banknote identifier and an outlet channel for the banknotes upon being returned, The device comprising a support surface that extends and slides horizontally between said inlet and said outlet channel and has a central longitudinal opening, two oscillating means situated under said support surface, on opposite sides of said central opening, to partially close said central opening, said oscillating means designed to interact with a bottom face of the support surface to hold and accumulate the banknotes temporarily, the device furthers comprising conveyors situated parallel to and acting above the support surface to take every banknote at the level of the inlet and to drag the banknote on said surface to fully stretch it out over the central opening, and a presser situated by the central opening of the support surface and movable selectively from a raised position over the support surface to a first work level (A) just under the support surface and to a second work level (B) more deeply under the support surface, the movement of the presser to the first level (A) causing an oscillating of the oscillating means and the passage of every banknote under the support surface between the presser and the oscillating means, whereas the movement of the presser to the second work level causes the banknotes to be discharged below, said oscillating means, when the device receives a banknote collection signal, and the device further comprising a means for sending the banknotes accumulated between the support surface and oscillating means to the outlet channel via horizontal movements of the support surface and of the oscillating means together, when the device receives a signal to return the banknotes, whereby the banknotes exit the device.

2. A device according to claim 1, wherein said support surface is guided between the sides of the body and wherein said oscillating means are composed of fins hanged under the support surface and stressed by springs to keep them normally against the surface.

3. A device according to claim 2, wherein in addition there are motor units for the horizontal movements of the support surface, to control the conveyor, to move the presser in height, and to control the means for sending the banknotes to the outlet channel, said motor units operate in synchronism in reply to a signal of coming from a banknote entering the inlet, to a signal of return being enabled, or to a signal of collection being enabled.

4. A device according to claim 1, wherein in addition there are motor units for the horizontal movements of the support surface, to control the conveyor, to move the presser in height, and to control the means for sending the banknotes to the outlet channel, said motor units operate in synchronism in reply to a signal coming from a banknote entering the inlet, to a signal of return being enabled, or to a signal of collection being enabled.

5. A device according to claim 1, wherein the conveyors are formed by worm elements with at least one adjacent branch that can be moved longitudinally on the support surface, wherein said presser is a plate guided and movable in height through the central opening of the support surface, and wherein the means for sending the banknotes to the return channel are rollers for gripping and advancing the banknotes accumulated between the support surface and said outlet channel.

6. A device according to claim 3, wherein in addition there are motor units for the horizontal movements of the support surface, to control the conveyor, to move the presser in height, and to control the means for sending the banknotes to the outlet channel, said motor units operate in synchronism in reply to a signal coming from a banknote entering the inlet, to a signal of return being enabled, or to a signal of collection being enabled.

* * * * *